US007410361B2

(12) United States Patent
Sumitani et al.

(10) Patent No.: US 7,410,361 B2
(45) Date of Patent: Aug. 12, 2008

(54) TERMINAL FOR SELECTIVELY COUPLING LOADS IN PARALLEL OR IN SERIES

(75) Inventors: Yoichiro Sumitani, Rancho Palos Verdes, CA (US); Lin Chun-Yi, Xinzhuang (TW); Chih-Huang Hsiao, Taipei (TW)

(73) Assignee: Sound Sources Technology, Torrance, CA (US)

( * ) Notice: Subject to any disclaimer, the term of this patent is extended or adjusted under 35 U.S.C. 154(b) by 0 days.

(21) Appl. No.: 11/580,679

(22) Filed: Oct. 13, 2006

(65) Prior Publication Data

US 2008/0090470 A1 Apr. 17, 2008

(51) Int. Cl.
*H01R 24/00* (2006.01)

(52) U.S. Cl. ..... 439/49; 439/511

(58) Field of Classification Search ..... 439/49, 439/511, 43, 54, 507

See application file for complete search history.

(56) References Cited

U.S. PATENT DOCUMENTS

| | | | | |
|---|---|---|---|---|
| 2,992,401 | A | 7/1961 | Lewis | |
| 3,796,848 | A * | 3/1974 | Southworth, Jr. | 200/175 |
| 4,537,689 | A * | 8/1985 | Morrow et al. | 508/143 |
| 5,040,990 | A * | 8/1991 | Suman et al. | 439/34 |
| 5,326,275 | A * | 7/1994 | Murakami | 439/189 |
| 5,367,243 | A | 11/1994 | Wells et al. | |
| 5,711,681 | A * | 1/1998 | Hasegawa | 439/86 |
| 5,989,061 | A * | 11/1999 | Amberg et al. | 439/510 |
| 6,215,273 | B1 | 4/2001 | Shy | |
| 6,222,342 | B1 | 4/2001 | Eggert et al. | |
| 6,325,675 | B1 | 12/2001 | Harmeyer | |
| 6,454,585 | B1 * | 9/2002 | Homer et al. | 439/218 |
| 6,650,548 | B1 * | 11/2003 | Swetland | 361/780 |
| 6,656,000 | B2 | 12/2003 | Abdo | |
| 6,782,111 | B1 | 8/2004 | Wagner, II et al. | |
| 6,933,452 | B2 * | 8/2005 | Liu | 200/51 R |
| 6,997,759 | B1 | 2/2006 | Zahnen et al. | |
| 7,094,094 | B2 | 8/2006 | Zahnen et al. | |
| 7,168,977 | B2 * | 1/2007 | Reibke et al. | 439/507 |
| 2004/0196987 | A1 * | 10/2004 | Sahyoun | 381/111 |
| 2005/0045459 | A1 * | 3/2005 | Liu | 200/200 |
| 2007/0032100 | A1 * | 2/2007 | Yang et al. | 439/43 |

* cited by examiner

*Primary Examiner*—Gary F. Paumen
(74) *Attorney, Agent, or Firm*—Stetina Brunda Garred & Brucker; S. Samuel Sumitani

(57) ABSTRACT

A terminal assembly for selectively coupling multiple electrical loads in parallel or in series includes a plurality of jumper contacts in a spaced relationship. The jumper contacts may be in electrical communication with load terminals as well as source terminals. Connections made in a first group of electrically connectable pairings of adjacent jumper contacts couples the load terminals, and thus any loads attached thereto, in parallel. Connections made in a second group of electrically connectable pairings of adjacent jumper contacts couples the load terminals in series.

14 Claims, 7 Drawing Sheets

TERMINAL FOR SELECTIVELY COUPLING LOADS IN PARALLEL OR IN SERIES

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention generally relates to terminals for interconnecting electrical components. More particularly, the present invention relates to audio signal terminals for selectively establishing parallel or series connections between loads connected thereto.

2. Related Art

While significant improvements have been made in the development of high power loudspeakers, alternative solutions that utilize existing loudspeakers have been considered because of increased costs associated therewith. These alternative solutions have involved connecting the loudspeakers in series or in parallel for enhanced performance. The loudspeakers are connected to an audio signal source, which may be a stereo receiver, an amplifier, etc. As is generally understood, a series connection of multiple loudspeakers increases the load impedance, resulting in a more efficient operation of the audio signal source. However, with the increase in load impedance, there is a decrease in the voltage applied to each loudspeaker and a consequential decrease in the audio output of the same. On the other hand, parallel connections decrease the load impedance, and while each loudspeaker is applied a constant voltage level, current draw on the audio signal source increases.

In addition to individual loudspeakers having single voice coils, recent advances in loudspeakers, particularly in woofers and subwoofers, have introduced the use of multiple voice coils in a single loudspeaker. Dual voice coil subwoofers have two separate electrically isolated windings mounted to a common bobbin. Such loudspeakers are frequently used in car audio applications for increased flexibility in wiring. While power handling levels, frequency response, and other parameters remain the same whether connected in series or in parallel, the impedance "seen" by the audio signal source changes.

A number of devices to connect multiple loudspeakers or multiple voice coil elements of a single loudspeaker in parallel or in series have been contemplated. One is U.S. Pat. No. 6,656,000 to Abdo, which essentially teaches a pair of metallic blocks, a first block being electrically connected to a positive line from the audio signal source and a second block being electrically connected to a negative line from the audio signal source. The first block includes a pair of output terminals to be connected to the respective one of positive wires of the loads (voice coil element). The second block likewise includes a pair of output terminals to be connected to the respective one of negative wires of the loads. Such first embodiment is operative to connect the loads in parallel. A second embodiment includes essentially the same components, but includes only one output terminal for each block. Thus, the positive wire of one of the loads is connected to the first block, the negative wire of one of the loads is connected to the positive wire of the other load, and the negative wire of the other load is connected to the second block, connecting the loads in series. Another is the Applicant's co-pending U.S. patent application Ser. No. 11/453,647, entitled "Terminal Assembly for Selectively Coupling Loads in Parallel and In Series," which is wholly incorporated by reference herein.

As will be appreciated by one of ordinary skill in the art, the Abdo device essentially provides an accessible central junction for connecting the audio signal source and the wires of the loads. However, such prior devices are deficient in that it is still necessary to handle the actual wires of the loads to alter the configuration between series wiring and parallel wiring. Additionally, it is necessary to substitute different terminal blocks to switch between series wiring and parallel wiring. One major difficulty experienced by consumers in altering the configuration of loudspeakers is the clutter associated with handling the wires, and being unable able to ascertain whether the proper connections have been made. Therefore, there is a need in the art for an improved terminal assembly which can more readily switch the wiring configuration of electrical loads from parallel to series, and vice versa.

BRIEF SUMMARY

In accordance with one aspect of the present invention, there is provided a terminal assembly for selectively connecting a plurality of electrical loads in parallel or in series. The terminal assembly may include first and second sets of load terminals. Each set of load terminals may include a positive load terminal and a negative load terminal. Further, there may include a plurality of jumper contacts in a spaced relationship. At least one of the jumper contacts may be in electrical communication with one of the load terminals. The negative load terminal of the first set may be connectable to the positive load terminal of the second set. This connection may be made over a first group of electrically connectable pairings of adjacent jumper contacts. The respective ones of load terminals of the first set may be connectable to the corresponding ones of load terminals of the second set. This connection, on the other hand, may be made over a second group of electrically connectable pairings of adjacent jumper contacts. The terminal may further include a positive source terminal electrically connected to a first one of the plurality of jumper contacts, as well as a negative source terminal electrically connected to a second one of the plurality of jumper contacts. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. It is understood that the use of relational terms such as first and second, top and bottom, and the like are used solely to distinguish one from another entity without necessarily requiring or implying any such actual relationship or order between such entities.

Figure 1:
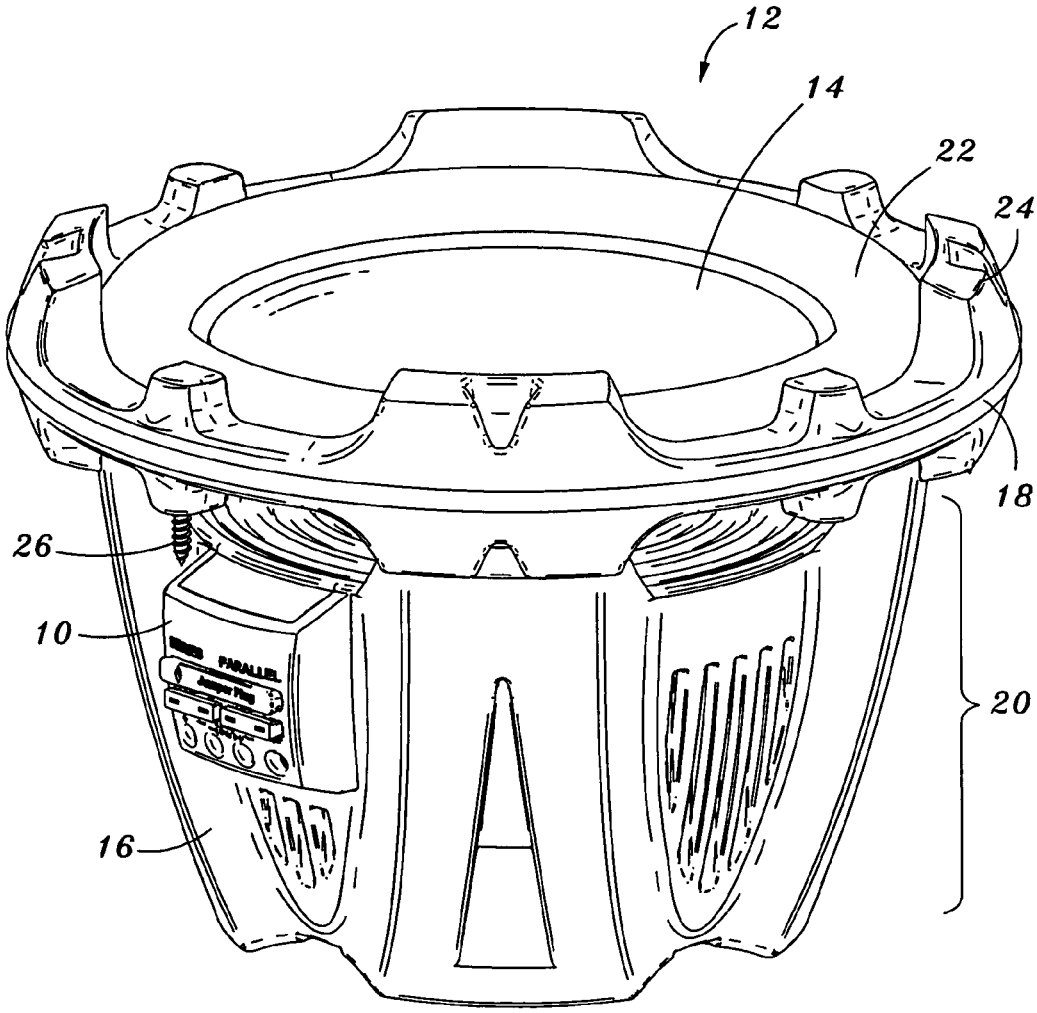
FIG. 1 is a perspective view of a terminal assembly in accordance with an embodiment of the present invention attached to a loudspeaker.

With reference to FIG. 1, in accordance with an aspect of the present invention, there is provided a terminal assembly 10 that is attachable to a loudspeaker 12. The loudspeaker 12 is preferably of the moving-coil type, where a diaphragm 14 is suspended from a basket 16 that is defined by an open top rim 18 and a base portion 20. The diaphragm 14 is attached to an annular flexible surround 22, which is also attached to the top rim 18.

For enhancing the decorative appearance of the face of the loudspeaker 12, there is provided a grille 24. Optionally, the grille 24 may include a mesh-like element that covers the entire face of the loudspeaker 12. However, as understood in the art, the grille 24 need not include such an element, and any decorative piece attached to the top rim 18 may be so referenced. The grille 24 may include various ornamental designs that are molded, engraved, painted, or otherwise impressed thereupon. In addition to its decorative functions, the grille 24 may cover various fasteners 26 used to attach the loudspeaker 12 to a speaker enclosure or other like structure.

As is well known in the art, in a moving coil loudspeaker, the diaphragm 14 is coupled to a cylindrical bobbin that has one or more voice coils wound thereon. Electrical current representative of an audio signal is passed through the voice coil winding and interacts with the magnetic fields produced by a permanent magnet, causing the bobbin and the diaphragm to vibrate in accordance with the signal. The voice coil winding includes a positive lead end and a negative lead end, both of which must be connected to the audio signal source. Preferably, the loudspeaker 12 for use in conjunction with a preferred embodiment of the terminal assembly 10 has dual voice coils, that is, there are two separate windings on the bobbin, with a first set of positive and negative lead ends of the first voice coil, and a second set of positive and negative lead ends of the second voice coil. As will be described in further detail below, the first and second voice coils may be connected to each other in a series relationship, as well as in a parallel relationship with respect to a single source, such as a mono amplifier. It is also contemplated that the first and second voice coils may be driven by independent signal sources, as in the case of a stereo amplifier with left and right signals.

Generally, the terminal assembly 10 serves as an interface between the leads of the voice coil and the leads from the audio signal source, and is preferably attached to the base portion 20 of the basket 16. While FIG. 1 illustrates the terminal assembly 10 being attached to the loudspeaker 12, one of ordinary skill in the art will appreciate that it may be attached to any other suitable location such as speaker enclosures, stereo receivers, and the like. Further, while the terminal assembly 10 is described in relation to the loudspeaker 12 and connections to the voice coils and other components thereof, it will be understood that they are presented by way of example only and not of limitation. The terminal assembly 10 may interconnect any other suitable electrical load and source in the same manner as will be further detailed below.

Figure 2:
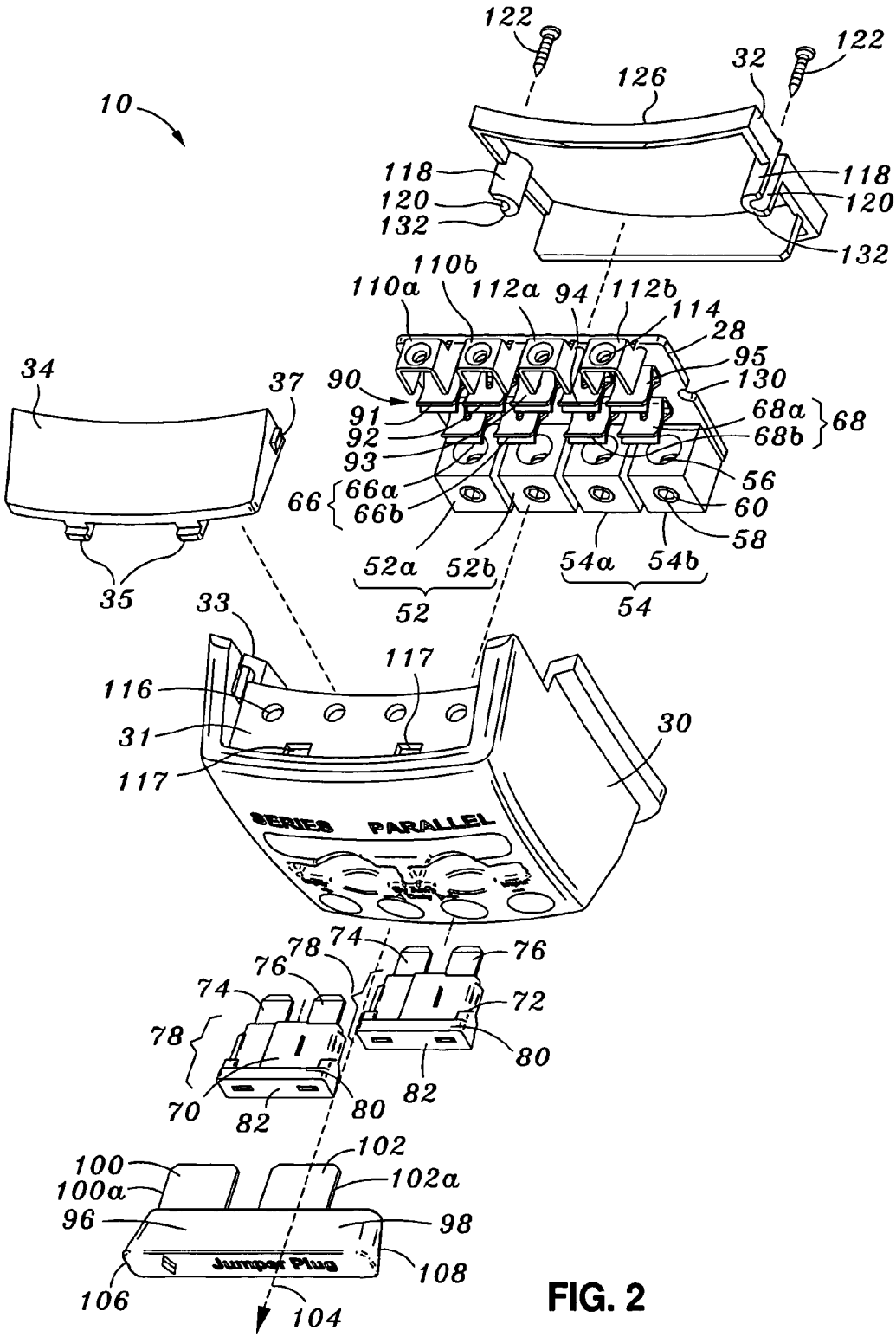
FIG. 2 is an exploded perspective view of the terminal assembly including the main housing, a circuit board, a back cover, a top cover, a jumper, and a pair of fuses in accordance with an aspect of the present invention.
Figure 3:
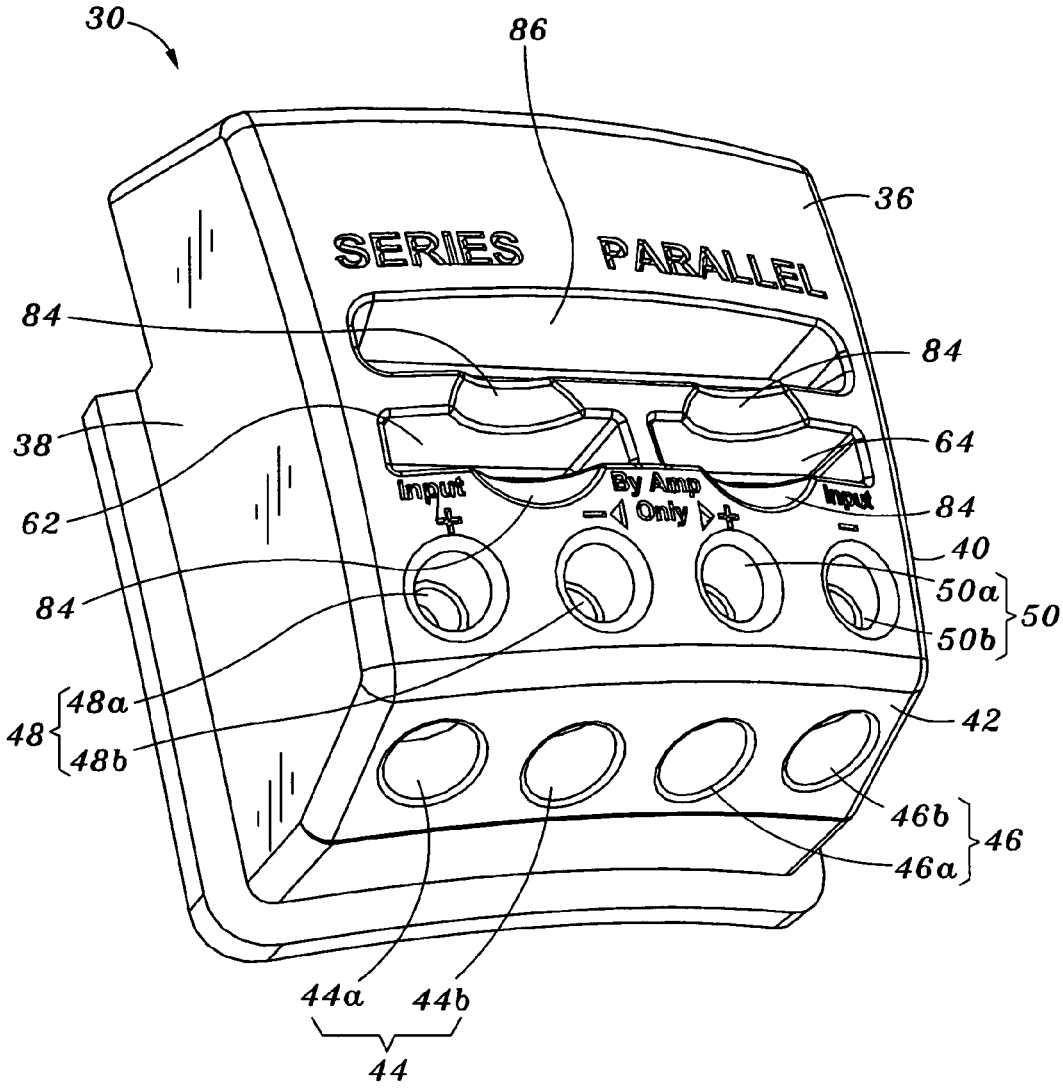
FIG. 3 is a frontal perspective view of a main housing of the terminal assembly.

With reference now to FIG. 2, there is shown the terminal assembly 10 in accordance with one aspect of the present invention, including a circuit board 28 configured to be enclosed within a main housing 30. The completed terminal assembly 10 further includes a back cover 32 and a top cover 34. In further detail as shown in FIG. 3, the main housing 30 is defined by a front face 36, a left wall 38, a right wall 40, and a bottom wall 42.

According to one embodiment of the present invention, the front face 36 defines a first source positive input port 44*a* and a first source negative input port 44*b* that are collectively referred to as first source input ports 44. In this embodiment, the bottom wall 42 further defines a second source positive input port 46*a* and a second source negative input port 46*b* that are collectively referred to as second source input ports 46. It is understood that the first and second source input ports 44, 46 extend into the interior of the main housing 30 and have the same diameter. While shown as having a cylindrical configuration, it will be appreciated that any other suitable shape may be readily substituted without departing from the scope of the present invention. Additionally, the front face 36 defines a first source positive terminal access port 48*a* and a first source negative terminal access port 48*b*, collectively referred to as first source terminal access ports 48. The front face 36 also defines a second source positive terminal access port 50*a* and a second source negative terminal access port 50*b*, collectively referred to as second source terminal access ports 50. As described above in relation to the first source and second source inputs 44, 46, the first source and second source terminal access ports 48, 50 have generally cylindrical configurations, with each one having the same diameter.

With further reference to FIG. 2, the circuit board 28 has attached thereto a positive first source terminal 52*a* and a negative first source terminal 52*b*, collectively referred to as first source terminals 52, as well as a positive second source terminal 54*a* and negative second source terminal 54*b*, collectively referred to as second source terminals 54. In one preferred embodiment, each of the first source and second source terminals 52, 54 are generally defined by a cube configuration, with first cylindrical bores 56 extending therethrough, and second cylindrical bores 58 extending perpendicularly to the respective one of the first cylindrical bores 56. The first cylindrical bores 56 of each of the first and second source terminals 52, 54 are coaxial with the first source and second source input ports 44, 46, while the second cylindrical bores 58 of each of the first source and second source terminals 52, 54 are coaxial with the first source and second source terminal access ports 48, 50. The second cylindrical bores 58 may include helical grooves therein, with clamping bolts 60 threaded therethrough. The wires from the audio signal source are understood to be inserted through the first source and second source input ports 46, 48, and through the first source and second source terminals 52, 54. Such leads may be secured to the first and second source terminals 52, 54 by tightening the clamping bolts 60 with a compatible tool inserted through the first source and second source terminal access ports 48, 50.

An exemplary embodiment of the terminal assembly 10 in which main body 30 defines the first source and second source input ports 44, 46, and the first source and second source terminal access ports 48, 50 to be compatible with the first source and second source terminals 52, 54 has been described. It will be recognized by one of ordinary skill in the art, however, that any other suitable source terminals may be utilized without departing from the scope of the present invention. It will also be recognized that the main body 30 may have alternative configurations to accommodate such source terminals. In other words, the configuration of the main body 30, particularly as it relates to the first source and second source input ports 44, 46 and the first source and second source terminal access ports 48, 50 is dependent on the configuration of the first source and second source terminals 52, 54, and vice versa. Changes to one may necessitate an accommodating change to the other. By way of example only, the first source and second source terminals 52, 54 may include biasing members incorporated therein for frictionally retaining the wires from the signal source. In such a configuration, there would be no need for the first source and second source terminal access ports 48, 50. Along these lines, it is understood that such wires may have bare ends that are engaged to the first source and second source terminals 52, 54, or may have various terminations attached thereto such as banana plugs and the like.

Referring to FIGS. 2 and 3, the main body 30 defines a first source fuse slot 62 and a second source fuse slot 64 to provide access to a first set of fuse contacts 66 and a second set of fuse contacts 68. In a preferred embodiment, the first source fuse slot 62 is located alongside the second source fuse slot 64, and in combination, extends substantially across the main body 30. The first set of fuse contacts 66 includes a source end fuse contact 66*a* and a load end fuse contact 66*b*, and the second set of fuse contacts 68 includes a source end fuse contact 68*a* and a load end fuse contact 68*b*. The particular naming conventions of the respective ones of the first and second set of fuse contacts 66, 68 will be further considered below. By way of example only and not of limitation, the respective ones of the first and second set of fuse contacts 66, 68 are all extruded U-shaped members with opposed gripping elements biased towards the center thereof. The first and second sets of fuse contacts 66, 68 are configured to mate with first and second fuses 70 and 72, respectively, and are attached to the circuit board 28. The first and second fuses 70, 72 have identical configurations, and as such, each includes a pair of spaced electrodes 74 and 76 adapted to a body 78. The body 78 includes a rectangular flange portion 80 defining a top surface 82. The spacing distance between the electrodes 74 and 76 is approximately the same as the spacing distance between the source end fuse contact 66*a* and the load end fuse contact 66*b*, and between the source end fuse contact 66*a* and the load end fuse contact 68*b*. It will be recognized that the first and second fuses 70, 72 may have various physical dimensions, and may of any automotive type with a configuration that conforms to industry standards such as the Mini (10.92×16×3.81 mm), ATO® (19.05×18.54×5.08 mm) or Maxi (29.21×34.29×8.89 mm). Within the body 78 is a shorting wire (not shown) electrically connecting the electrodes 74 and 76. The shorting wire is configured to break the electrical connection between the electrodes 74 and 76 upon over-current. It is understood that the over-current rating, or the amperage at which the short will be broken, may be varied. Specifics relating to how the first and second fuses 70, 72 protect the loudspeaker 12 will become more apparent below. As will be understood, the electrodes 74 and 76 is constructed of electrically conductive material such as metal, while the body 78 is constructed of plastic or other like non-conductive material. As indicated above, the first fuse 70 is attached to the terminal assembly 10 through the first source fuse contact slot 62, and the second fuse 72 is attached to the terminal assembly 10 through the second fuse contact slot 64. In a first preferred embodiment as shown in FIG. 1, it is contemplated that upon engagement to the first and second set of fuse contacts 66, 68, the top surface 82 and the flange portion 80 of the first and second fuses 70, 72 extends beyond the front face 36 such that it may be readily removed. In another preferred embodiment, it is contemplated that upon engagement to the first and second sets of fuse contacts 66, 68, the top surface 82 of the first fuse 70 is flush with front face 36 of the main housing 30 to reduce the profile of the terminal assembly 10. In both of the aforementioned embodiments, the main housing 30 also defines a pair of opposed partial frusto-spherical recesses 84 for both the first source fuse slot 62 and the second source fuse slot 64. It is understood that the recesses 84 makes the flange portion 80 of both of the first and second fuses 70, 72 accessible for a user's fingers to grip. Thus, the first fuse 70 or the second fuse 72 may be easily replaced as necessary. Alternative configurations of the recesses 84 besides the aforementioned partial frusto-spherical shape are also deemed to be within the scope of the present invention. One of ordinary skill in the art will readily appreciate such alternatives and incorporate the same into the main housing 30.

The main housing 30 also defines a jumper access slot 86 that extends substantially across the front face 36 and into the interior of the main housing 30. Further, the jumper access slot 86 provides access to a set of jumper contacts 90 attached to the circuit board 28. As illustrated in FIG. 2, the set of jumper contacts 90 includes a first jumper contact 91, a second jumper contact 92, a third jumper contact 93, a fourth jumper contact 94, and a fifth jumper contact 95, each being configured to receive a jumper 96. As utilized herein, the reference numerals 91-95 are understood to refer to the specific one of the jumper contacts, while the reference numeral 90 is understood to refer broadly to all of the jumper contacts. It is contemplated that the jumper contacts 90 have the equivalent structure of the extruded U-shaped member as described in relation to the first and second set of fuse contacts 66, 68 above.

The jumper 96 includes a non-conductive body 98, with a first conductive prong 100 and a second conductive prong 102 fixed thereto in a spaced relationship. More particularly, the first conductive prong 100 and the second conductive prong 102 are spaced asymmetrically about a center 104 of the non-conductive body 98. The non-conductive body 98 is defined by a proximal end 106 and a distal end 108, and preferably, the outer edge of the first conductive prong 100 is in the vicinity of the proximal end 106 while the outer edge of the second conductive prong 102 is more centrally disposed. In further detail, the first and second conductive prongs 100, 102 have widths to span and electrically connect at least a pair of adjacent ones of the jumper contacts 90. Further details pertaining to the function of the jumper 96 and as it relates to the jumper contacts 90 will be described in further detail below.

The circuit board 28 also includes a first set of load terminals 110 and a second set of load terminals 112. The first set of load terminals 110 includes a first positive load terminal 110*a* and a first negative load terminal 110*b*, and the second set of load terminals 112 includes a second positive load terminal 112*a* and a second negative load terminal 112*b*. As illustrated in FIG. 2, the first and second set of load terminals 110, 112 all have a cube-shaped configuration with a wire passage hole 114. As indicated above, it is contemplated that the terminal assembly 10 is permanently attached to the loudspeaker 12, and so the connections from the first and second set of load terminals 110, 112 to the lead ends of the first and second voice coils, respectively, are likewise permanent. For example, the lead ends of the first and second voice coils may be soldered onto the first and second set of load terminals 110, 112.

The main housing 30 defines an upper wall 31 that includes a set of lead access holes 116. Preferably, each of the lead access holes is coaxial with the wire passage holes 114 on the first and second set of load terminals 110, 112, such that the leads of the first and second voice coils are passed therethrough. Such leads may remain hidden with the cover 34, and passed through the rear of the terminal assembly 10. For attaching the top cover 34 to the main housing 30, the upper wall 31 defines top cover mating notches 117 configured to receive mating tabs 35. As will be appreciated, the mating tabs 35 may be inserted into the mating notches 117 with the top cover 34 at a near a perpendicular angle to the upper wall 31, and locked into place by rotating it about the same. The top cover 34 further includes locking wedges 37 that are engageable to the main housing 30. It is understood that the mating tabs 35 and the locking wedges 37 are of a unitary construction with the top cover 34.

As indicated above, the circuit board 28 is held within the interior of the main housing 30. The back cover 32 includes a pair of opposed semi-cylindrical support members 118 extending perpendicularly to the back cover 32, and the interior portions 120 of the support members 118 are configured to receive fasteners 122 that secure the back cover 32 to the main housing 30. The back cover 32 is mounted between lip portions 33 of the main housing 30, that is, the exterior face 126 of the back cover 32 is generally co-planar with the exterior surface 128 of the lip portion 33. Additionally, the circuit board 28 includes semi-circular notches 130 that receive the fasteners 122, and end surfaces 132 of the support members 118 abut against the circuit board 28 to secure the same to the main housing 30. It will be appreciated that this keeps all of the respective terminals, contacts, and the like in proper alignment with the slots and ports of the main housing 30 as described above.

Figure 4:
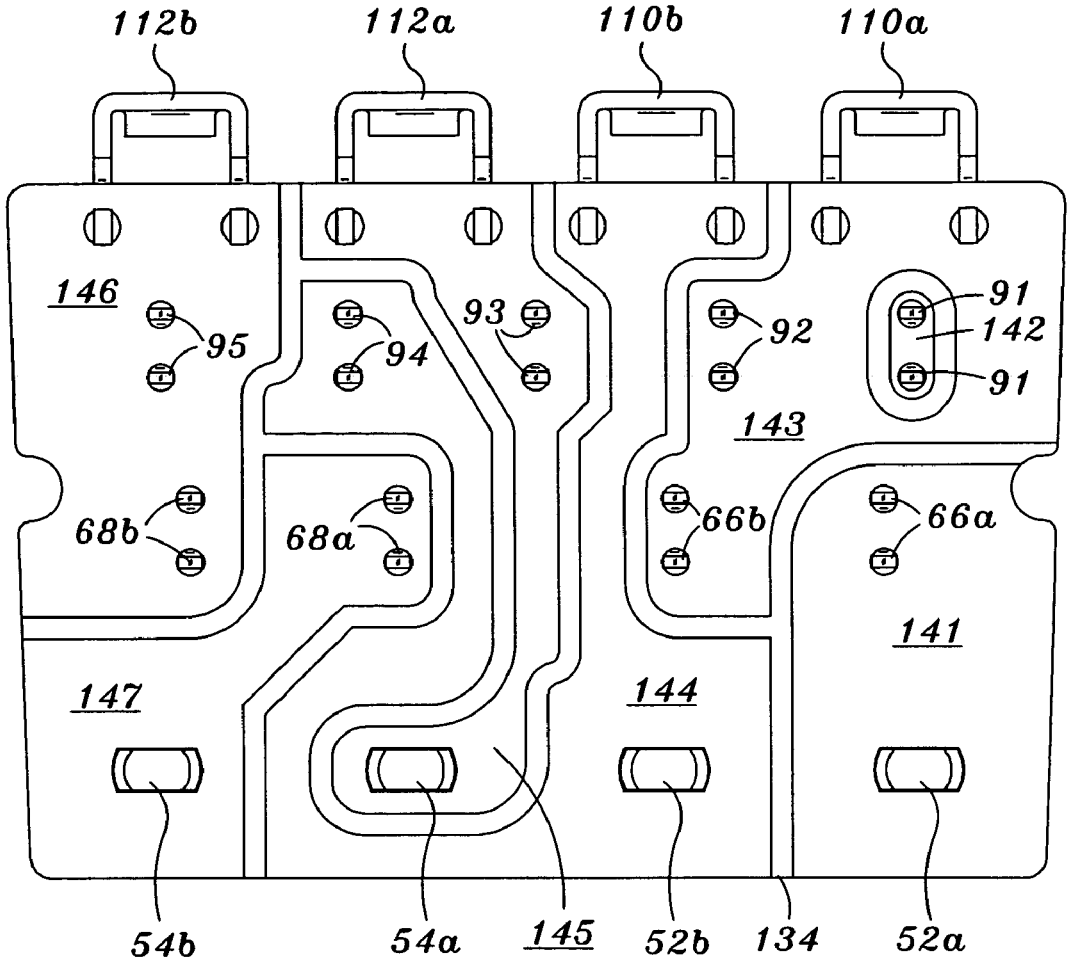
FIG. 4 is a rear plan view of a circuit utilized in the terminal assembly of the present invention, illustrating the various circuit regions.

With reference to FIG. 4, the reverse side of the circuit board 28, that is, the side without the contacts and the terminals will be detailed. The circuit board 28 includes conductive plating laminated on an underlying, non-conductive substrate. One of ordinary skill in the art will appreciate that the conductive plating is a sheet of copper or other like material, and the substrate may comprise phenolic resin, fiberglass reinforced with epoxy resin, ceramics, and so forth. Prior to attachment of the contacts and the terminals, the bare circuit board 28 is etched to divide the same into unconnected circuit regions as will be further detailed below. More particularly, the conductive plating on the regions of the circuit board 28 for etchings 134 is removed so that the non-conductive substrate is exposed and there are no mechanical/electrical connections across the same. The techniques involved in producing the etchings 134 are well known in the art, and any such alternative techniques may be readily substituted without departing from the scope of the present invention.

The circuit board 28 is comprised of a first circuit region 141, a second circuit region 138, a third circuit region 143, a fourth circuit region 144, a fifth circuit region 145, a sixth circuit region 146, and a seventh circuit region 147 each being separated by the etchings 124. As indicated above, each of the first through seventh circuit regions 141-147 are conductive, and is an electrical junction with respect to the components attached thereto. However, the first through seventh circuit regions 141-147 are electrically isolated with respect to each other absent connections made by the first and second fuses 70, 72 and the jumper 96. In further detail as related to the arrangement of the jumper contacts 90, the first through fifth jumper contacts 91-96 are laterally spaced along the circuit board 28 with at least one of the jumper contacts 91-96 being in electrical communication with one of the first and second set of load terminals 110, 112. The first circuit region 141 includes the first positive source terminal 52*a* and the first source end fuse contact 66*a*. The second circuit region 142 includes just the first jumper contact 91. The third circuit region 143 includes the first positive load terminal 110*a*, the second jumper contact 92, and the first load end fuse contact 66*b*. The fourth circuit region 144 includes the first negative source terminal 52*b*, the fourth jumper contact 94, and the first negative load terminal 110*b*. The fifth circuit region 145 includes the second positive source terminal 54*a*, the third jumper contact 93, and the second positive load terminal 112*a*. The sixth circuit region 146 includes the second negative load terminal 112*b*, the fifth jumper contact 95, and the second load end jumper contact 68*b*. The seventh circuit region 146 includes the second negative source terminal 54*b* and the second source end fuse contact 68*a*.

With the understanding imparted by the detailed explanation of the layout of the circuit board 28, the connections made by the jumper 96 to link the aforementioned circuit regions and how such connections enable parallel or series couplings of the first and second voice coils will now be considered.

Figure 5:
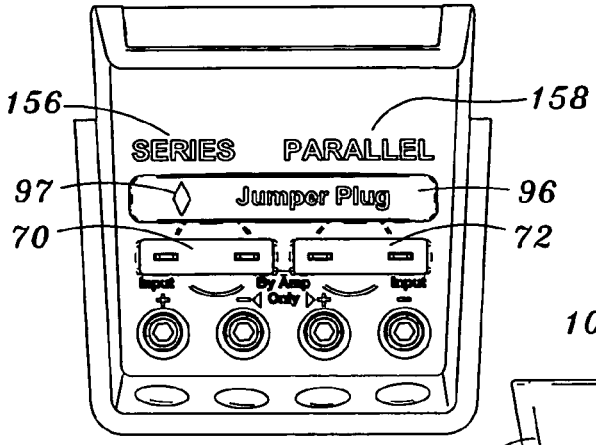
FIG. 5 is a frontal view of the terminal assembly with a jumper attached thereto in a first orientation to connect the loads in a series relationship.
Figure 6:
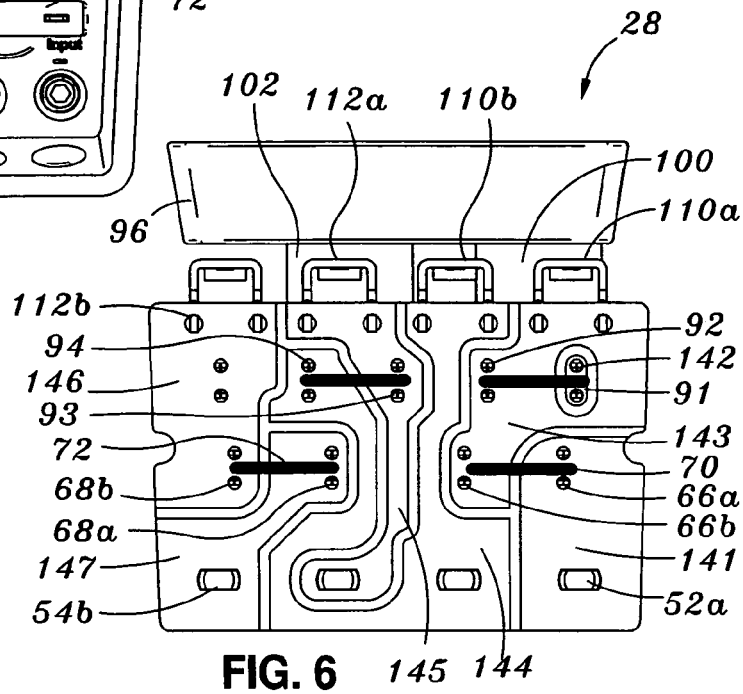
FIG. 6 is a rear view of the circuit showing circuit regions shorted by the jumper to connect a pair of loads in series.
Figure 7:
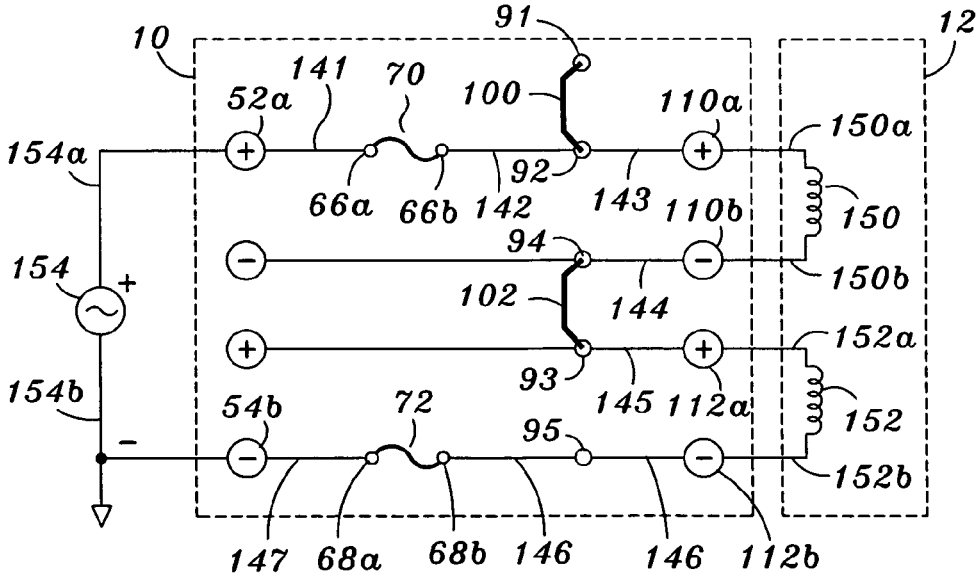
FIG. 7 is a schematic diagram of the circuit with the loads connected in series.

With reference to FIGS. 5, 6, and 7, the first negative load terminal 110*b* is electrically coupled to the second positive load terminal 112*a* to connect a first load 150 and a second load 152 in a series relationship with respect to an audio signal source 154, over a first group of electrically connectable pairings of adjacent jumper contacts 90. More particularly, the positive lead of the signal source 154*a* is connected to the first positive source terminal 52*a*, and the negative lead of the signal source 154*b* is connected to the second negative source terminal 54*b*. The first load 150 includes a positive lead end 150*a* electrically connected to the first positive load terminal 110*a*, and a negative lead end 150*b* electrically connected to the first negative load terminal 110*b*. Additionally, the second load 152 includes a positive lead end 152*a* electrically connected to the second positive load terminal 112*a*, and a negative lead end 152*b* electrically connected to the second negative load terminal 112*b*. According to a preferred embodiment, the first load 150 and the second load 152 are voice coils in the loudspeaker 12.

In accordance with the description of one preferred embodiment of the present invention as set forth above, under normal operating conditions the first fuse 70 shorts the first source end fuse contact 66*a* to the first load end fuse contact 66*b*, and the second fuse 72 shorts the second source end fuse contact 68*a* to the second load end fuse contact 68*b*. Therefore, the first circuit region 141 is electrically connected to the third circuit region 143, and the seventh circuit region 147 is electrically connected to the sixth circuit region 147.

In order to connect the first and second loads 150, 152 in series, the jumper 96 is attached to the terminal assembly 10 in a first orientation as shown in FIG. 5. The jumper 96 includes an indicator 97, and the main housing 30 includes a "series" label 156 and a "parallel" label 158. The first orientation is such that the indicator 97 appears generally aligned with the "series" label 156. As indicated above, the first and second conductive prongs 100, 102 are asymmetrically attached to the center 104 of the jumper 96. In the first orientation, the first conductive prong 100 shorts the first jumper contact 91 to the second jumper contact 92, thereby electrically connecting the second circuit region 142 to the third circuit region 143. As will be appreciated, however, the third circuit region is not connected to any other components so the first conductive prong is not utilized except as a placeholder. The second conductive prong 102 shorts the third jumper contact 93 to the fourth jumper contact 94, thereby electrically connecting the fourth circuit region 144 to the fifth circuit region 145. The first group of adjacent pairs of jumper contacts mentioned above is understood to be generally comprised of the pair of the first and second jumper contacts 91, 92 and the pair of the third and fourth jumper contacts 93, 94.

Figure 8:
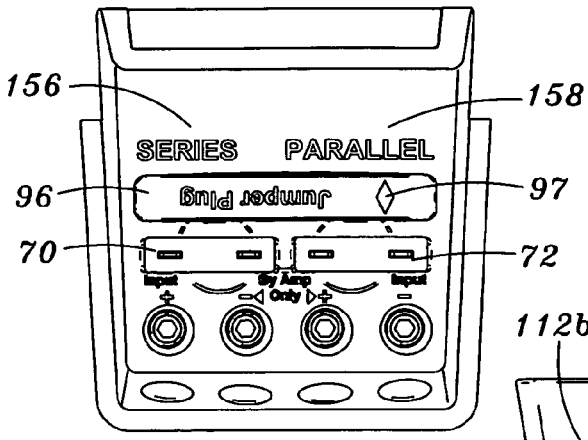
FIG. 8 is a frontal view of the terminal assembly with a jumper attached thereto in a second orientation to connect the loads in a parallel relationship.
Figure 9:
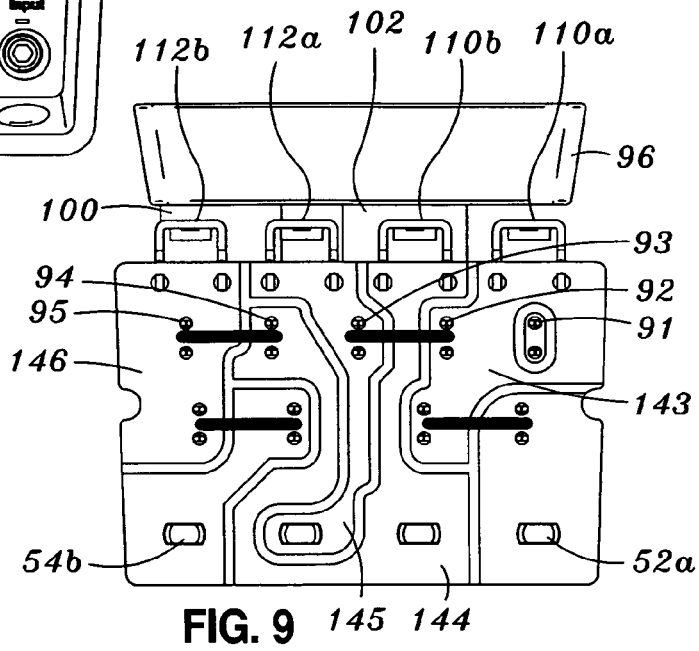
FIG. 9 is a rear view of the circuit showing circuit regions shorted by the jumper to connect the pair of loads in parallel.
Figure 10:
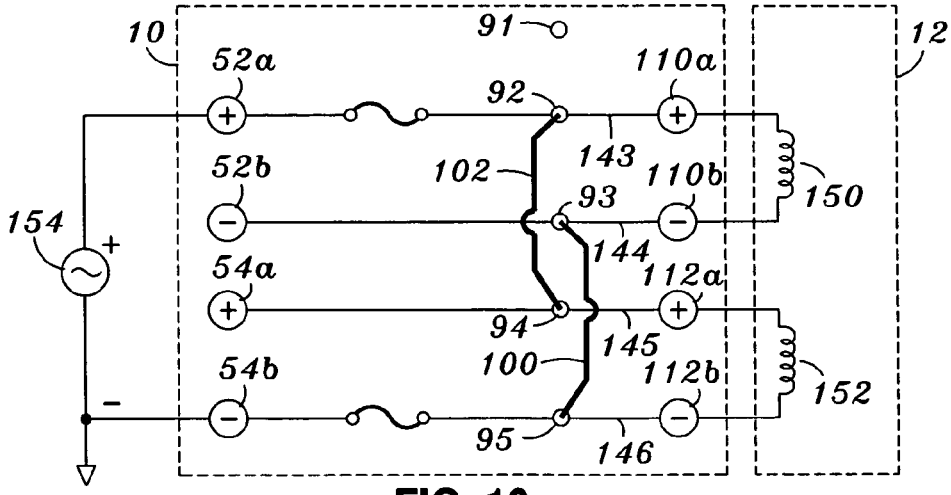
FIG. 10 is a schematic diagram of the circuit with the loads connected in parallel.

With reference to FIGS. 8, 9, and 10, the first positive load terminal 110*a* is electrically coupled to the second positive load terminal 112*a*, and the first negative load terminal 110*b* is electrically coupled to the second negative load terminal 112*b*. Therefore, with the appropriate connections from the respective one of the first and second load terminals 110, 112 being made, the first load 150 is connected in parallel with the second load 152 with respect to the audio signal source 154. The foregoing connections are made over a second group of electrically connectable pairings of adjacent jumper contacts 90. In this regard, the jumper 96 is attached to the terminal assembly 10 in a second orientation. In the second orientation, the indicator 97 appears generally aligned with the "parallel" label 158. The first conductive prong 100 shorts the fourth jumper contact 94 to the fifth jumper contact 95, and the second conductive prong 102 shorts the second jumper contact 92 to the third jumper contact 93. Accordingly, the third circuit region 143 is connected to the fifth circuit region 145, and the fourth circuit region 144 is connected to the sixth circuit region 146. The second group of electrically connectible pairings is understood to include the pair of the second and third jumper contacts 92, 93, and the pair of the fourth and fifth jumper contacts 94, 95. It is understood that the connection of the first and second loads 150, 152, the audio signal source 154, and the first and second fuses 70, 72 are identical in all respects to the aforementioned description accompanying FIGS. 5, 6, and 7.

To prevent the jumper 96 from inadvertently sliding from one of the, it is contemplated that the width of the jumper access slot 86 is substantially equivalent to the non-conductive body 98, and that at least a portion of the non-conductive body 98 is inserted through the jumper access slot 86. Accordingly, lateral movement of the jumper 96 is prevented since the proximal end 106 and the distal end 108 abut the jumper access slot 86. The portion of the non-conductive body 98 protruding from the jumper access slot 86 provides a gripping area for the user to remove the jumper 96.

Figure 11:
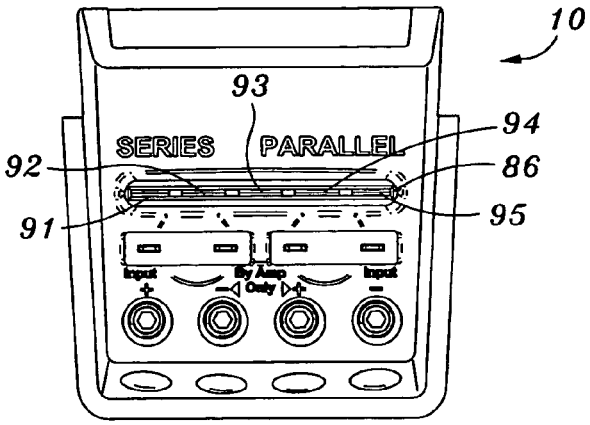
FIG. 11 is a frontal view of the terminal assembly with the jumper removed from the circuit.
Figure 12:
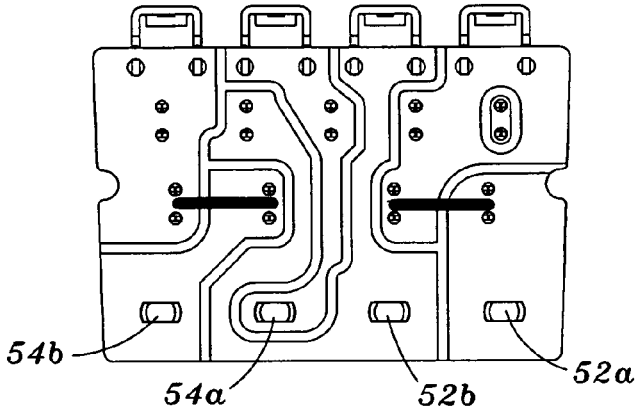
FIG. 12 is a frontal view of the circuit with the jumper removed from the circuit.
Figure 13:
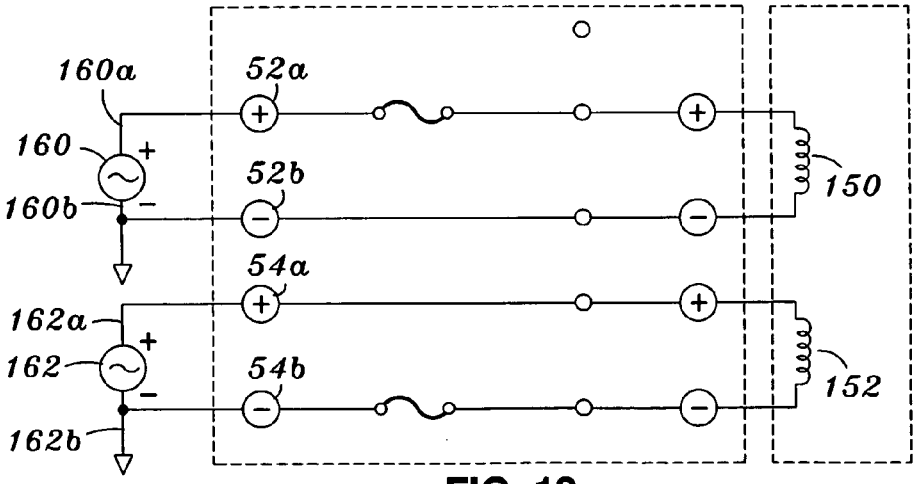
FIG. 13 is a schematic diagram of the circuit with the loads connected to independent signal sources.

Turning to FIGS. 11, 12, and 13, the terminal 10 is shown without the jumper 96 attached to the jumper contacts 90, and each of the first, second, third, fourth, and fifth jumper contacts 91-95 are exposed through the jumper access slot 86. In one preferred embodiment, the jumper access slot 86 may be covered to prevent debris from entering the interior of the main housing 30. In this particular arrangement, there are two audio signal sources 160, 162 with each having a positive lead and a negative lead. The first audio signal source 160 has a positive lead 160*a* electrically connected to the first positive source terminal 52*a*, and a negative lead 160*b* electrically connected to the first negative source terminal 52*b*. Further, the second audio signal source 162 has a positive lead 162*a* electrically connected to the second positive source terminal 52*a*, and a negative lead 162*b* electrically connected to the second negative source terminal 52*b*. In this configuration, the first audio signal source 160 and the second audio signal source 162 synchronously transmit the same audio signal, but its amplification is produced by separate amplifier units. Without interconnections between the jumper contacts 90, the signal from the first source 160 travels directly to the first load 150, and the signal from the second source 162 travels directly to the second load 152. In this configuration, the first and second audio signal sources 160, 162 are left and right sources in a stereo amplifier.

As will be appreciated from the detailed description of one preferred embodiment, the terminal assembly 10 in accordance with such embodiment improves the capability of switching between a parallel connection and a series connection between the plurality of loads 150, 152. Specifically, the jumper 96 may be attached to a first grouping of adjacent pairs of jumper contacts for a series connection, and the jumper 96 may be attached to a second grouping of adjacent pairs of jumper contacts for a parallel connection. Where it is desirable to connect to two separate audio signal sources 160, 162, to each of the loads 150, 152, the jumper 96 may be removed.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A terminal assembly for selectively connecting a plurality of electrical loads in parallel or in series, the terminal assembly comprising:

first and second sets of load terminals, each set of load terminals including a positive load terminal and a negative load terminal; and a plurality of jumper contacts in a spaced relationship, at least one of the jumper contacts being in electrical communication with one of the load terminals, the negative load terminal of the first set being connectible to the positive load terminal of the second set over a first group of electrically connectible pairings of adjacent jumper contacts, and the respective ones of the positive and negative load terminals of the first set being connectible to the corresponding ones of the positive and negative load terminals of the second set over a second group of electrically connectible pairings of adjacent jumper contacts.

2. The terminal assembly of claim 1, further comprising a jumper having a non-conductive body and a plurality of conductive prongs in a spaced relation fixed asymmetrically about the center of the non-conductive body, the conductive prongs each being removably engageable to at least a pair of adjacent ones of the jumper contacts.

3. The terminal assembly of claim 2, wherein the jumper is in a first orientation and the conductive prongs connect the adjacent jumper contacts of the first group of pairings thereof, the first set of load terminals being electrically connected to the second set of load terminals in a series relationship.

4. The terminal assembly of claim 2, wherein the jumper is in a second orientation and the conductive prongs connect the adjacent jumper contacts of the second group of pairings thereof, the first set of load terminals being electrically connected to the second set of load terminals in a parallel relationship.

5. The terminal assembly of claim 2, further comprising an enclosure for housing the load terminals and the jumper contacts.

6. The terminal assembly of claim 5, wherein the enclosure defines a jumper receiving slot overlapping the jumper contacts.

7. The terminal assembly of claim 1, further comprising:

a positive source terminal electrically connected to a first one of the plurality of jumper contacts; and a negative source terminal electrically connected to a second one of the plurality of jumper contacts.

8. The terminal assembly of claim 7, further comprising an enclosure for housing the load terminals, the jumper contacts, and the positive and negative source terminals, the housing defining source input ports corresponding to and aligned with the positive and negative source terminals.

9. The terminal assembly of claim 7, further comprising:

a secondary positive source terminal electrically connected to the positive load terminal of the second set; and a secondary negative source terminal electrically connected to the negative load terminal of the first set.

10. The terminal assembly of claim 7, further comprising a first fuse electrically connecting the positive source terminal to the first one of the plurality of jumper contacts.

11. The terminal assembly of claim 7, further comprising a second fuse electrically connecting the negative source terminal to the second one of the plurality of jumper contacts.

12. A circuit for interconnecting a plurality of electrical loads, the circuit comprising:

a first circuit segment including a first positive source terminal, a first positive load terminal, and a second jumper contact electrically interconnected to each other, the first circuit segment including an isolated area with a first jumper contact;

a second circuit segment including a first negative source terminal, a first negative load terminal, and a fourth jumper contact electrically interconnected to each other;

a third circuit segment including a second positive source terminal, a second positive load terminal, and a third jumper contact electrically connected to each other; and a fourth circuit segment including a second negative source terminal, a second negative load terminal, and a fifth jumper contact electrically connected to each other;

each of the circuit regions being electrically isolated from the other circuit regions.

13. The circuit of claim 12, wherein the first circuit segment is subdivided into a load region including a load end fuse contact and a source region including a source end fuse contact, the load region being electrically isolated from the source region.

14. The circuit of claim 12, wherein the fourth circuit segment is subdivided into a load region including a load end fuse contact and a source region including a source end fuse contact, the load region being electrically isolated from the source region.

* * * * *